US008932133B2

(12) United States Patent
Cortenraad et al.

(10) Patent No.: US 8,932,133 B2
(45) Date of Patent: Jan. 13, 2015

(54) GAME BOARD, PAWN AND SYSTEM FOR PLAYING BOARD GAMES

(75) Inventors: Hubertus Maria Rene Cortenraad, Eindhoven (NL); Martin Ouwerkerk, Eindhoven (NL); Anthonie Hendrik Bergman, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1978 days.

(21) Appl. No.: 11/575,315

(22) PCT Filed: Sep. 8, 2005

(86) PCT No.: PCT/IB2005/052926

§ 371 (c)(1),
(2), (4) Date: Mar. 15, 2007

(87) PCT Pub. No.: WO2006/033037

PCT Pub. Date: Mar. 30, 2006

(65) Prior Publication Data

US 2008/0004110 A1 Jan. 3, 2008

(30) Foreign Application Priority Data

Sep. 21, 2004 (EP) ..... 04104563

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***A63F 3/00*** | (2006.01) |
| ***A63F 3/02*** | (2006.01) |

(52) U.S. Cl.

CPC ..... *A63F 3/00643* (2013.01); *A63F 3/00697* (2013.01); *A63F 2003/00659* (2013.01); *A63F 2009/241* (2013.01); *A63F 2003/00826* (2013.01); *A63F 2003/00889* (2013.01); *A63F 2003/00886* (2013.01); *A63F 2300/1075* (2013.01)

USPC ..... 463/34; 273/236; 273/238; 273/260; 273/261

(58) Field of Classification Search

USPC ..... 463/34; 273/236, 238, 260, 261

See application file for complete search history.

(56) References Cited

U.S. PATENT DOCUMENTS

| | | | | |
|---|---|---|---|---|
| 2,670,208 A | | 4/1950 | Wales | |
| 4,082,285 A | * | 4/1978 | Bathurst | 463/14 |
| 4,369,975 A | | 1/1983 | Tarc | |

(Continued)

FOREIGN PATENT DOCUMENTS

| | | |
|---|---|---|
| DE | 2060042 | 6/1972 |
| DE | 10036218 A1 | 2/2001 |

(Continued)

*Primary Examiner* — Sunit Pandya
*Assistant Examiner* — Wei Lee

(57) ABSTRACT

A system for playing board games includes a game board and at least one pawn. The game board includes a display configured to display on a board surface a game board layout. The display is further configured to display a pawn input image on the board surface. The pawn includes a contact surface for supporting the pawn on the board surface, and an image input part cooperating with the board surface to receive the pawn input image. The pawn also includes an image surface to display a pawn output image, and a device for relaying the pawn input image from the image input part to the image surface.

20 Claims, 8 Drawing Sheets

(56) References Cited

U.S. PATENT DOCUMENTS

| | | | | |
|---|---|---|---|---|
| 4,391,447 | A * | 7/1983 | Dudley | 273/238 |
| 4,545,582 | A | 10/1985 | Andrews | |
| 5,030,158 | A * | 7/1991 | Gal et al. | 446/128 |
| 5,121,926 | A | 6/1992 | Pfaender | |
| 5,462,281 | A * | 10/1995 | Gaito et al. | 273/238 |
| 5,556,102 | A * | 9/1996 | Huang | 273/299 |
| 6,032,393 | A * | 3/2000 | Maxim | 40/548 |
| 6,036,189 | A * | 3/2000 | Gomez et al. | 273/118 R |
| 6,761,634 | B1 * | 7/2004 | Peterson et al. | 463/30 |
| 2004/0036213 | A1 * | 2/2004 | Lindsey | 273/146 |
| 2004/0106455 | A1 * | 6/2004 | Shinoda | 463/43 |
| 2004/0125078 | A1 * | 7/2004 | Nishimori et al. | 345/156 |

FOREIGN PATENT DOCUMENTS

| | | |
|---|---|---|
| EP | 1302223 | 4/2003 |
| FR | 2719494 | 10/1995 |
| GB | 2086243 | 5/1982 |
| GB | 2310805 | 9/1997 |
| WO | 9211909 | 7/1992 |
| WO | 9603188 | 2/1996 |

* cited by examiner

GAME BOARD, PAWN AND SYSTEM FOR PLAYING BOARD GAMES

The invention relates to a game board with a board surface and display means for displaying on the board surface a game board layout.

The invention also relates to a pawn comprising a contact surface for supporting the pawn on a board surface of a game board.

The invention also relates to a system for playing board games comprising a game board and at least one pawn according to the invention.

A game board as described above may be realized as a table with a built-in display or a separate display may be put on the table. The display itself then functions as the actual game board. In contrast with conventional game boards, the display can emulate almost every game board and a complete pile of classical game boards is superfluous. However, while the appearance of the game board may be varied for playing various board games, the appearance of the pawns remains fixed. Most board games require a dedicated set of pawns. For each extra board game a whole set of extra pawns is required, which set has to be bought and stored. If one or some of the pawns get lost, the board game can no longer be played.

It is an object of the invention to provide a game board, a pawn and a system for playing various board games, wherein the appearance of the pawns can be changed according to a game or game situation.

According to a first aspect of the invention a game board is provided comprising a board surface for supporting a pawn having an image input part, display means for displaying on the board surface a game board layout and a pawn input image for reception by the image input part of the pawn.

According to a second aspect of the invention a pawn is provided comprising a contact surface for supporting the pawn on a board surface of a game board, an image input part for receiving a pawn input image from the board surface, at least one image surface for displaying a pawn output image, and means for conducting the pawn input image to the at least one image surface.

According to a third aspect of the invention a system for playing board games is provided comprising a game board and at least one pawn according to the invention.

The pawn projects the part of the board surface underneath the pawn's image input part, which is normally not visible, to another part of the pawn, for example, the top or the side. Because the display means of the game board can display an inexhaustible variety of pawn input images on the board surface for projection on the image surface of the pawn, the appearance of the pawns can be changed according to the game or the game situation. Only one set of pawns is required for playing various board games. When not in use, all pawns in the set may be identical. During the game, the game board according to the invention provides for the required differences between the pawns, by displaying different pawn input images underneath the input image parts of different pawns. Additionally, pawns may, for example, be highlighted or their appearance may be completely changed during the game, according to the game situation. Highlighting or blinking is a good way to draw the attention of the user.

It is to be noted that the image input part may be part of the contact surface or even the complete contact surface.

The game board in accordance with the first aspect of the invention supplies the images which define the appearance of the pawns. The pawns in accordance with the second aspect of the invention are able to transport the images created by the game board to their image surface.

According to one embodiment of the invention the game board comprises detection means for detecting a contact of the board surface with the contact surface of the pawn and a position of the contact, and the display means are arranged for displaying the pawn input image at said position upon detection of the contact.

When the detection means detect that a pawn is removed from the game board, the pawn image for that pawn can be 'switched off'. As soon as the user places the pawn back on the game board, the detection means detect the position on the game board at which the pawn is placed and the display means display the new pawn image for projection on the image surface of the pawn. In such a system the user does not have to explicitly inform the system of a move he has made. The pawns can be moved in the same way as with classical board games.

According to another embodiment of the invention the contact surface comprises a code for identifying the pawn, and the detection means are arranged for detecting the code.

In many board games, it does not only matter where the pawns are situated on the board, but it also matters which pawn is at which position. When a user only moves one pawn at a time, the system may know which pawn is taken from the game board and put back at another position. When two or more pawns are removed from the game board at a time, the system does not know which one is put back on the game board first, unless the system is capable of identifying individual pawns. The code may be embodied visually, for example, as a bar code, a pictogram or with characters, magnetically, in a chip or in any other suitable and detectable way.

According to another embodiment of the invention the display means are arranged for displaying the pawn input image depending on the code.

In many board games, like for example chess, not all pawns are identical. When, at the start of a game of Chess, the detecting means detect which pawn is on which initial position on the game board, the display means may display a pawn image fitting the position of the pawn. The pawns may have individual codes allowing to follow which pawn is moved to which position during playing. For example, a pawn representing a knight may show an image of a horse on its image surface and a rook may show an image of a tower.

According to another embodiment of invention the detection means are arranged for detecting an orientation of the pawn relative to the game board.

In some board games the game situation may depend on the orientation of one or more pawns. For example, the freedom of movement for a pawn may be restricted to its orientation. The orientation of a pawn may, for example, be deduced from the orientation of a non-symmetrical shaped contact surface or a non-symmetrical visual identification code. Additionally, the pawn image may depend on the orientation of the pawn. For example, the pawn image may only be displayed when the image surface is directed towards one user. When the pawn is rotated, the pawn image disappears and the other user will not be allowed to see what pawn image was shown before.

According to another embodiment the display means are arranged for displaying a first and a second pawn input image on the board surface, the image input part of the pawn cooperates with the board surface to receive the respective pawn input images from the board surface, the pawn comprises a first and a second image surface for respectively showing a first and a second pawn output image, and means for conducting the first and the second pawn input image to the first and the second image surface, respectively. Obviously, a pawn may even comprise more than two image surfaces for displaying more than two pawn output images.

Using such a pawn, different pawn images can be shown to different users.

According to another embodiment of the invention the means for conducting the pawn input image comprise at least one optical element for obtaining the pawn output image being a sharp representation of the pawn input image.

Such optical elements may comprise a lens, a mirror, a bundle of optical fibers, a holographic layer or any other passive or active optical element or combination of such elements. If the output image is a sharp representation of the input image, detailed pictures can be used for display on the image surface of the pawn. Also moving images may be used, or one image or multiple unequal images may be displayed on multiple surfaces.

These and other aspects of the invention are apparent from and will be elucidated with reference to the embodiments described hereinafter.

BRIEF DESCRIPTION OF THE DRAWINGS

In the drawings:

FIG. 1 shows a schematic diagram of the system 1 according to the invention. The system 1 comprises a game board 2 and pawns 20. The game board 2 comprises a board surface 3 whereon various board games can be played. The game board 2 also comprises or is coupled to a processor 5, a memory 6 and a graphics generation unit 4 for enabling displaying on the board surface 3 a game board layout according to a selected board game. The board surface 3 may, for example be the surface of a display device, such as a LCD monitor, or of a transparent plate covering such a display device. Well known examples of board games are Chess, Backgammon, Scrabble, and Monopoly. The system according to the invention does not only enable the playing of classical known board games, but may also be used for completely new board games. Such new board games may include, for example, board games wherein the game board layout changes according to the run of the game. The memory 6, the processor 5 and the graphics generation unit 4 may be included in a personal computer (PC) or the game board may be coupled to a PC. Preferably the system also comprises a user interface 8 to enable the user to select board games, start new games, save games, load previously saved games, choose playing modes etc. The system may also comprise an Internet connection 9 which enables playing board games with or against other players from all over the world.

Figure 1:
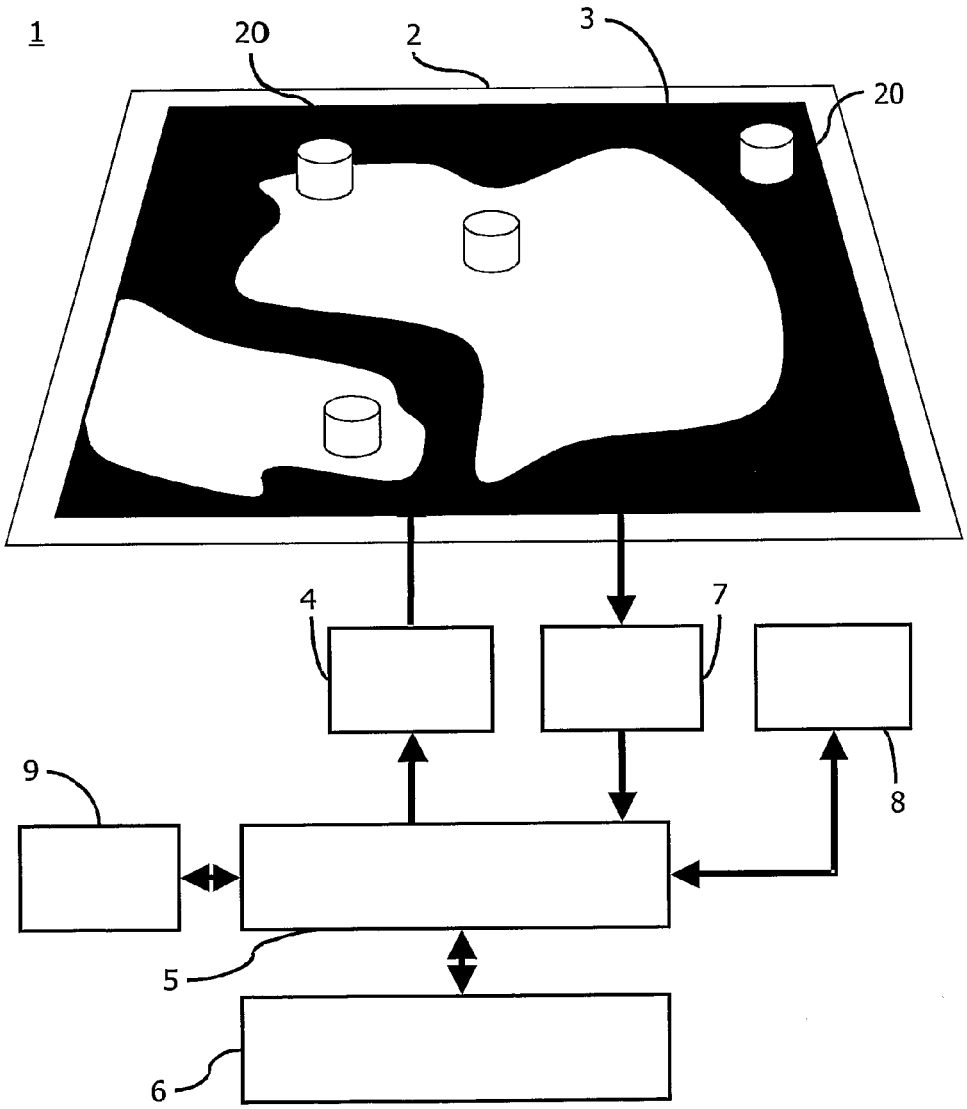
FIG. 1 shows a schematic diagram of the system according to the invention.

When a pawn input image is displayed on the board surface 3 the pawn receives the input image and conducts the pawn input image for display on the image surface. A detailed description of various embodiments of pawns according to the invention will be provided below, with reference to FIG. 2 to FIG. 7.

In a preferred embodiment the game board 2 also comprises a detection unit 7 for detecting a contact and the position of the contact of the contact surface of a pawn 20 with the board surface 3. In this preferred embodiment the pawn input image is displayed on the board surface 3 at said position upon detection of the contact. With the detection unit 7 the system 1 can follow the position of the pawns 20 during the game. The user does not have to explicitly inform the system 1 about the moves he makes. At the start of the game all pawns 20 are positioned at their starting location. During the game the detection unit 7 detects when a pawn 20 is removed form the board surface 3 and where it is put back. Thus, the system always knows where all pawns 20 are situated and where to display which pawn input images 22.

The detection unit 7 may, for example comprise a touch screen, which can detect the contact position and the shape of the contact surface, or a scanning display which can also detect a visual code on the contact surface 21. Scanning displays as such have been presented by Toshiba in May, 2003. The use of such a scanning display in the present invention has the additional advantage that the pawns can also be detected when their original location is not known. This will, for example, allow the playing of games in which the players can or have to choose where to place their pawns 20 on the board surface 3. It will also allow the playing of games in which players may remove used pawns 20 or add not yet used pawns 20. Distinction of individual pawns 20 also allows the system 1 to know which pawn 20 is put back at which position when two or more pawns 20 are removed from the board surface 3 at the same time.

In embodiments without a detection unit 7, the display may show, for example, a circle on the board surface 3 at the position where the user has to put the pawn 20. In this event the user may use the user interface 8 for making moves, the system shows the circle on the board surface and the user moves the pawn to the circle.

If the detection unit 7 comprise a touch screen, the user interface 8 may be displayed on (part of) the board surface 3. The size and the elements of the user interface 8 may vary according to the game, game situation and/or available options.

If the shape of the contact surface 21 or the code on the contact surface 21 is not completely symmetric, the detection unit 7 may also detect the orientation of the pawn 20. The game situation to be displayed may depend on the orientation of the pawn 20. For example, the freedom of movement for a pawn 20 may be restricted according to its orientation, or the pawn input image 22 may only be displayed when the image surface of the pawn 20 is facing a particular user. Alternatively, the pawn input image 22 may vary with the orientation of the pawn 20.

Figure 2:
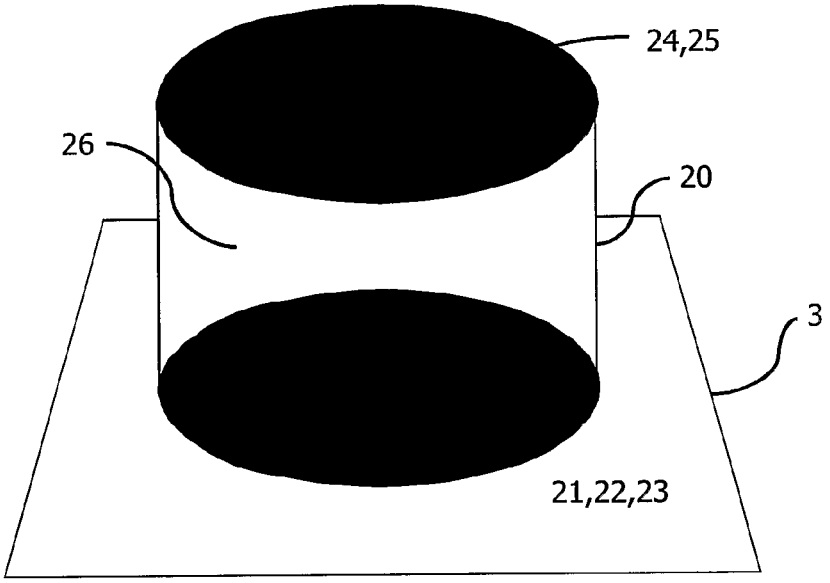
FIG. 2 shows an example of a pawn according to the invention.

FIG. 2 shows an example of a pawn 20 according to the invention. The contact surface 21 of the pawn 20 is placed on the board surface 3. The board surface 3 shows a pawn input image 22 underneath the contact surface 21. An image input part 23 of the pawn 20 receives the pawn input image 22. In this embodiment the whole pawn 20 is made out of transparent material, such as glass or transparent plastics, and the image input part 23 coincides with the contact surface 21. The pawn input image 22 shown in FIG. 2 is a colored disc, which is as large as the image input part 23. The pawn 20 conducts the pawn input image 22 to obtain a pawn output image 25 on an image surface 24. Preferably, the pawn 20 comprises transparent material like glass or transparent plastic for conducting the pawn input image 22. The conduction of the pawn input image 22 may also be realized by a hollow tube. The image surface 24 comprises a diffusive material, which may be the same material as is used for conducting the pawn input image 22. The pawn input image 22 is thus 'transported' to the image surface 24 and the appearance of the pawn can be changed by the system 1 according to the board game and the game situation. When the pawn input image 22 is just a colored disc, no further means are required for transporting the pawn input image. For displaying more complicated output images 25 on the image surface 24, some extra features have to be added to the pawn 20. Such advanced pawns 20 will be described below with reference to FIG. 4.

Figure 3:
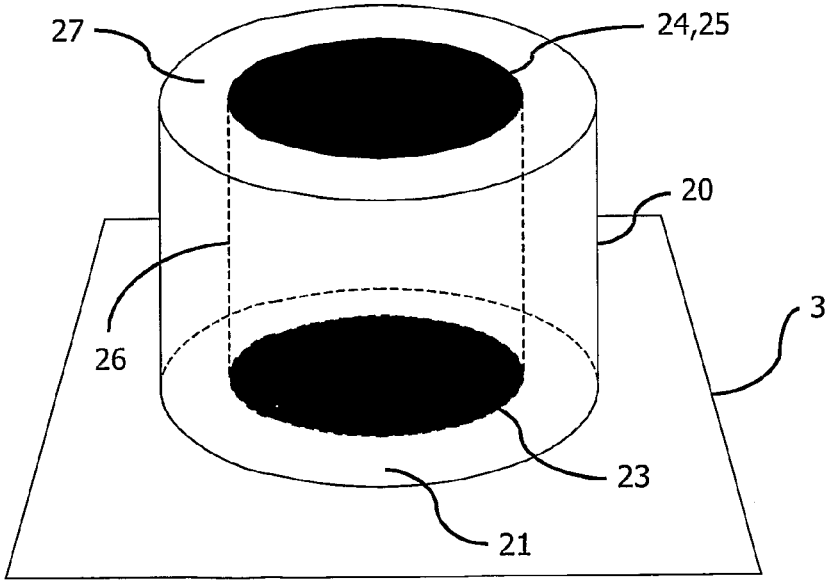
FIG. 3 shows an alternative embodiment of a pawn according to the invention.

FIG. 3 shows an alternative embodiment of a pawn 20 in accordance with the invention. This embodiment comprises all features of the embodiment shown in FIG. 2, and further comprises an opaque outer shell 27, which may be made of any kind of material. In this embodiment the contact surface 21 does comprise the image input part 23 and the bottom surface of the outer shell 27. An optional code for identifying the pawn 20 may be applied to the bottom surface of the outer shell 27.

Figure 4:
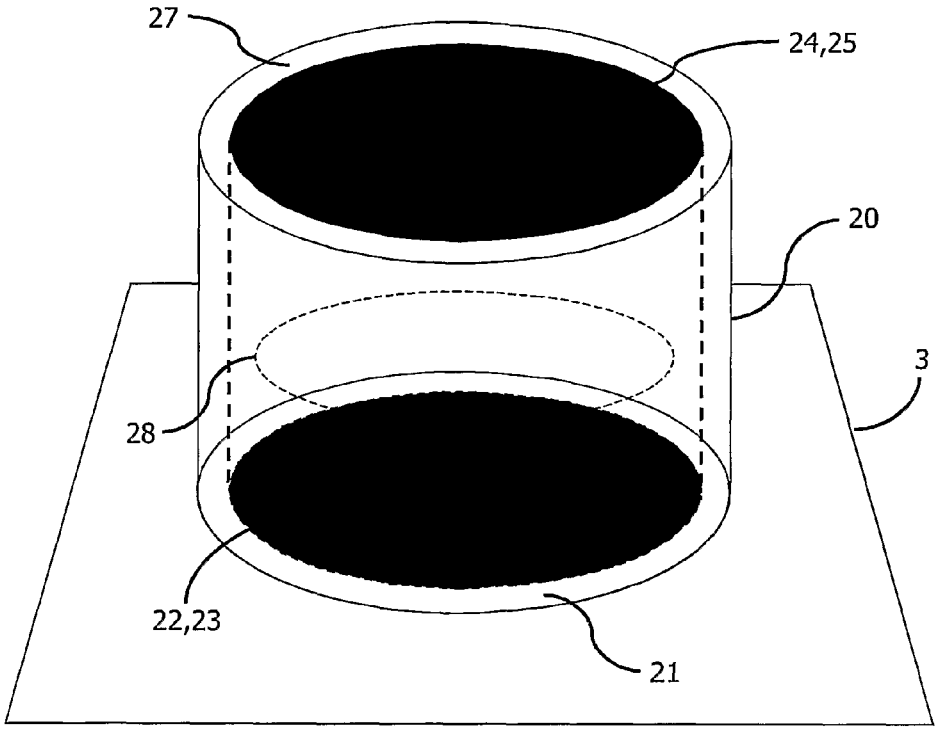
FIG. 4 shows an embodiment of a pawn according to the invention comprising a lens.

FIG. 4 shows an embodiment of a pawn 20 according to the invention, which comprises a lens 28. This embodiment comprises all features of the embodiment shown in FIG. 3, and further comprises a lens 28 to obtain the pawn output image 25 being a sharp representation of the pawn input image 22. If an optical element is used, such as a lens 28, to provide sharp representations of the pawn input image 22, pawn output images 25 may be used, which show two or more colors. By using the contrast between different colors, all kinds of pictures can be shown on the image surface 24. In the embodiment shown in FIG. 4, a letter "A" is projected onto the image surface 24 of the pawn 20.

Figure 5A:
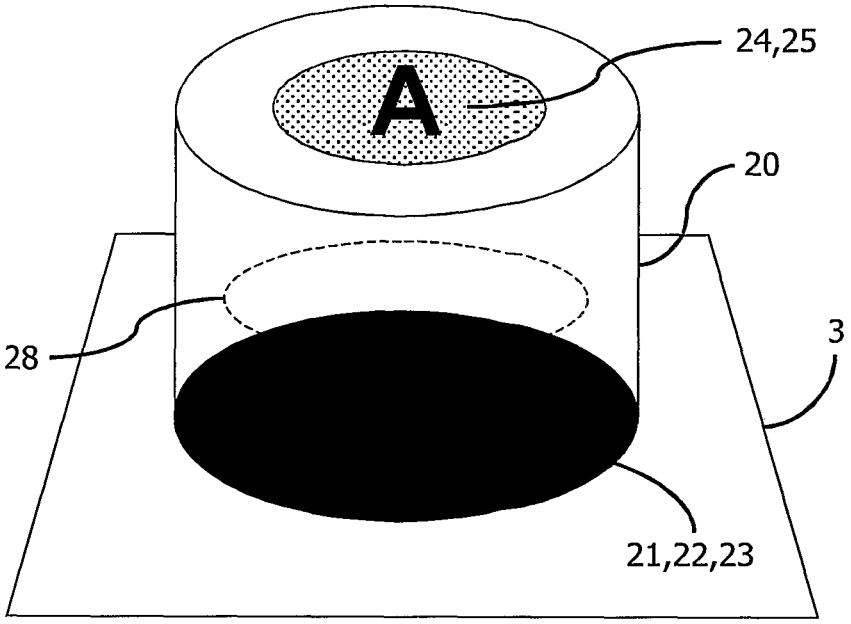
FIGS. 5*a*, 5*b* and 5*c* show embodiments of pawns according to the invention comprising lenses.
Figure 5B:
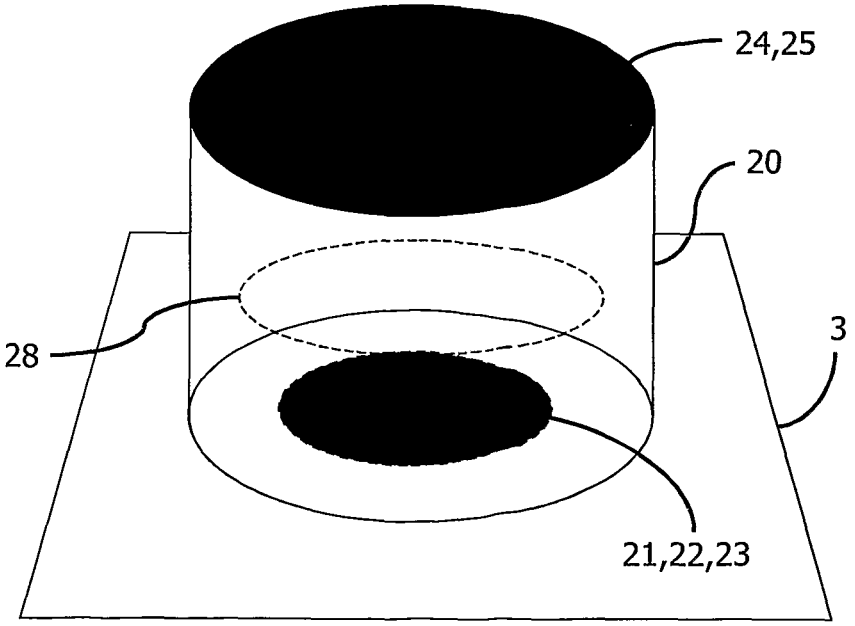
Figure 5C:
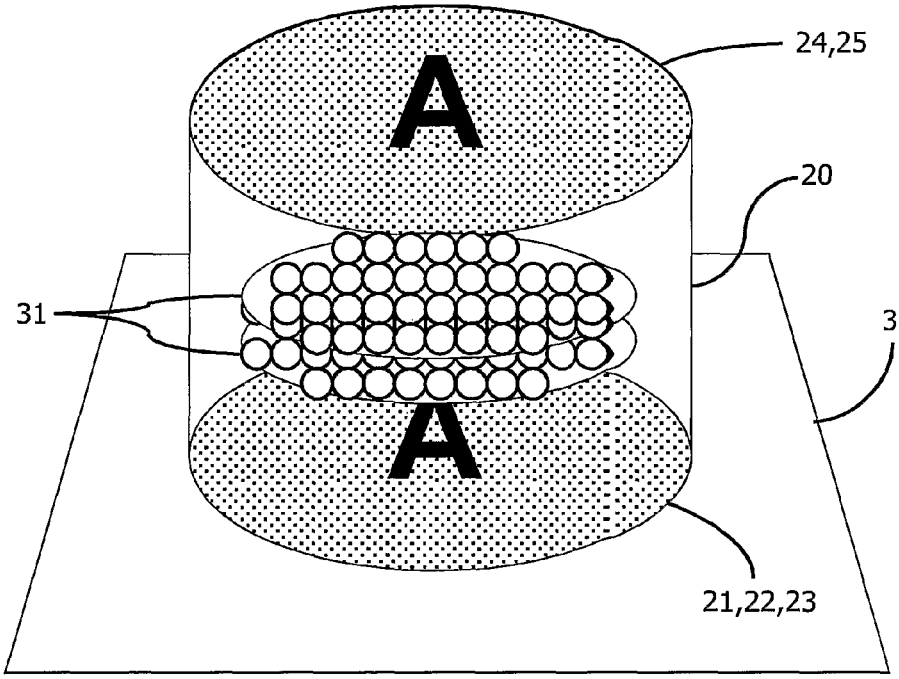

FIGS. 5*a*, 5*b* and 5*c* show alternative embodiments of pawns comprising lenses 28. In the embodiments shown in FIGS. 5*a* and 5*b* the lens 28 is used for magnifying/minifying the pawn input image 22. It is to be noted that the pawn 20 in FIG. 5*a*, when turned upside down, will yield the magnifying pawn 20 of FIG. 5*b*. Thus, the same pawn 20 can be used for minifying or magnifying pawn input images 22. In the embodiment shown in FIG. 5*c* the optical element is a lens array (31) which comprises two stacked arrays of small lenses.

Figure 6A:
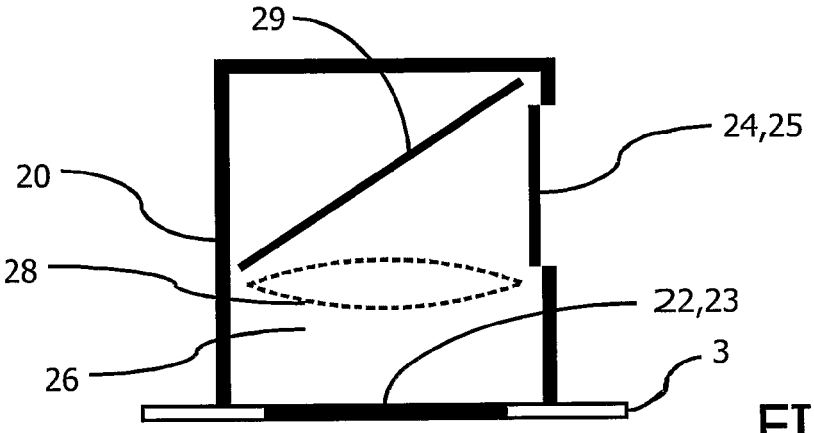
FIGS. 6*a*, 6*b* and 6*c* show embodiments of pawns according to the invention comprising optical elements for making the pawn output image a sharp representation of the pawn input image on the image surface.
Figure 6B:
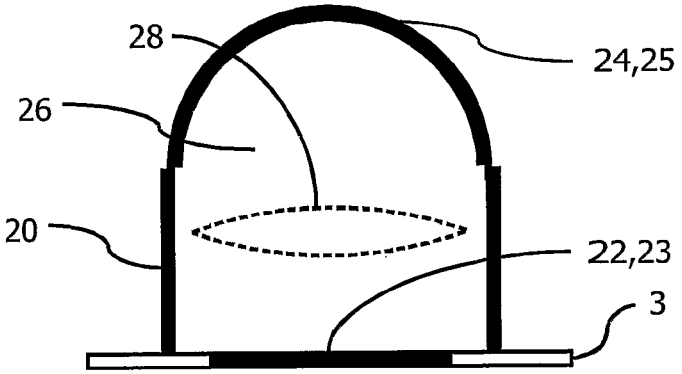
Figure 6C:
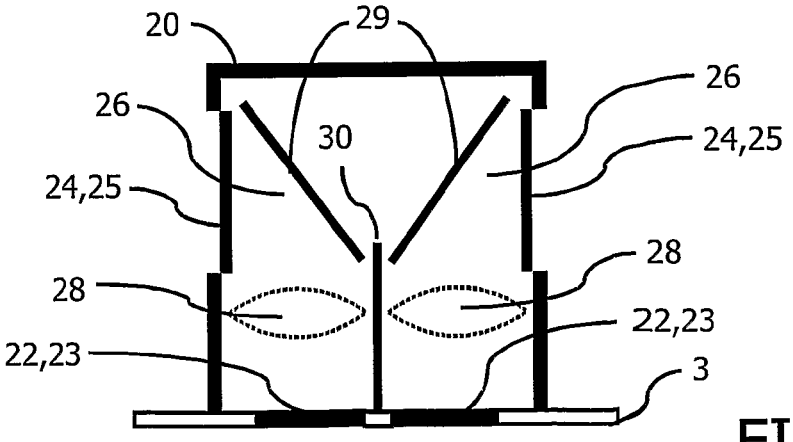

FIGS. 6*a*, 6*b* and 6*c* show embodiments of pawns 20 according to the invention which comprise optical elements to obtain a sharp representation of the pawn input image 22 on the image surface 24. In FIG. 6*a* the pawn 20 comprises a lens 28 and a mirror 29 for conducting the pawn input image 22 and to provide a sharp representation of it on the image surface 24 which is located at the side of the pawn 20. The pawn output image 25 is only visible from one side of the pawn 20. With such a pawn 20, games can be played, like for example Stratego, in which a user is not allowed to see the image on the pawn 20 of another player.

In the embodiment shown in FIG. 6*b* a dome shaped diffuser is used for constituting an image surface 24 with a wide viewing range.

In FIG. 6*c* an embodiment is shown wherein different sides of the pawn 20 can show different images. The pawn comprises two lenses 28 and two mirrors 29 for conducting two respective pawn input images 22. Preferably a separation wall 30 is used to avoid cross talk. The pawn 20 shown in FIG. 6*c* can be used, for example, in games like Scrabble wherein a player has pawns 20, which other players are not allowed to see until it is placed on the game board.

FIGS. 6*a*, 6*b* and 6*c* show lenses 28, mirrors 29 and a separation wall 30 as optical elements which can be comprised in the pawn 20. Other types of optical elements can also be used. For example, a bundle of carefully aligned optical fibers can be used for conducting the pawn input image 22. Such bundles of fibers can also be used for magnifying or minifying the pawn input image 22. If the bundle of optical fibers is not carefully aligned a pawn input image 22 can also be conducted; but then the pawn output image 25 will not be a sharp representation of the pawn input image 22.

An alternative embodiment of a pawn 20 which displays two different output images 25, may use color filters. In this embodiment one input image 22 may comprise, for example red and green parts. One image surface 24 which is situated behind a filter that transmits only red light will only show the red parts in the output image 25. The image surface 24 behind a filter that only transmits green light will only show the green parts.

Figure 7:
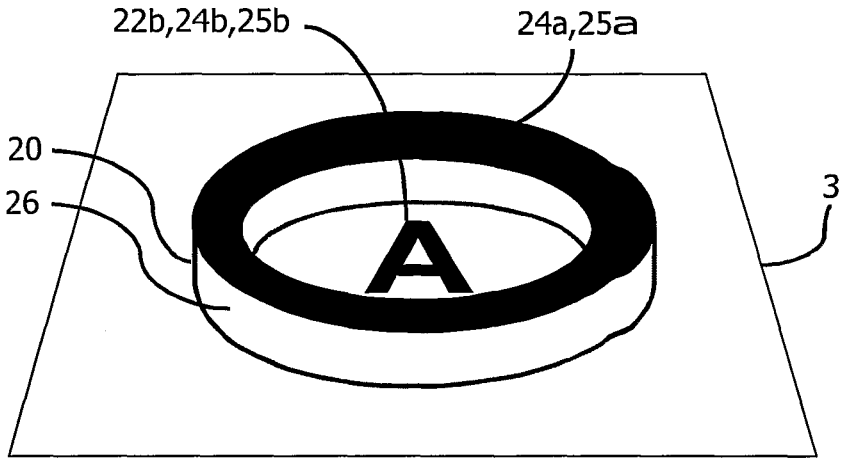
FIG. 7 shows an alternative embodiment of a pawn according to the invention.

FIG. 7 shows an alternative embodiment of a pawn 20 according to the invention. FIG. 7 shows a pawn 20, which is a ring of transparent material. A first part of the pawn input image comprises a colored ring. The transparent ring conducts the first part of the input image to a first image surface 24*a*. A second part 22*b* of the pawn input image comprises a letter "A". This second part 22*b* of the pawn input image can directly be observed by the user. The second part 22*b* of the input image constitutes the pawn output image 25*b*. The surface board 3 functions as a second image surface 24*b*. When the pawn 20 is moved, the pawn output images 25*a*, 25*b* can be moved together with the pawn 20. For a user, the second pawn output image 25*b* will appear to be part of the pawn 20.

Figure 8:
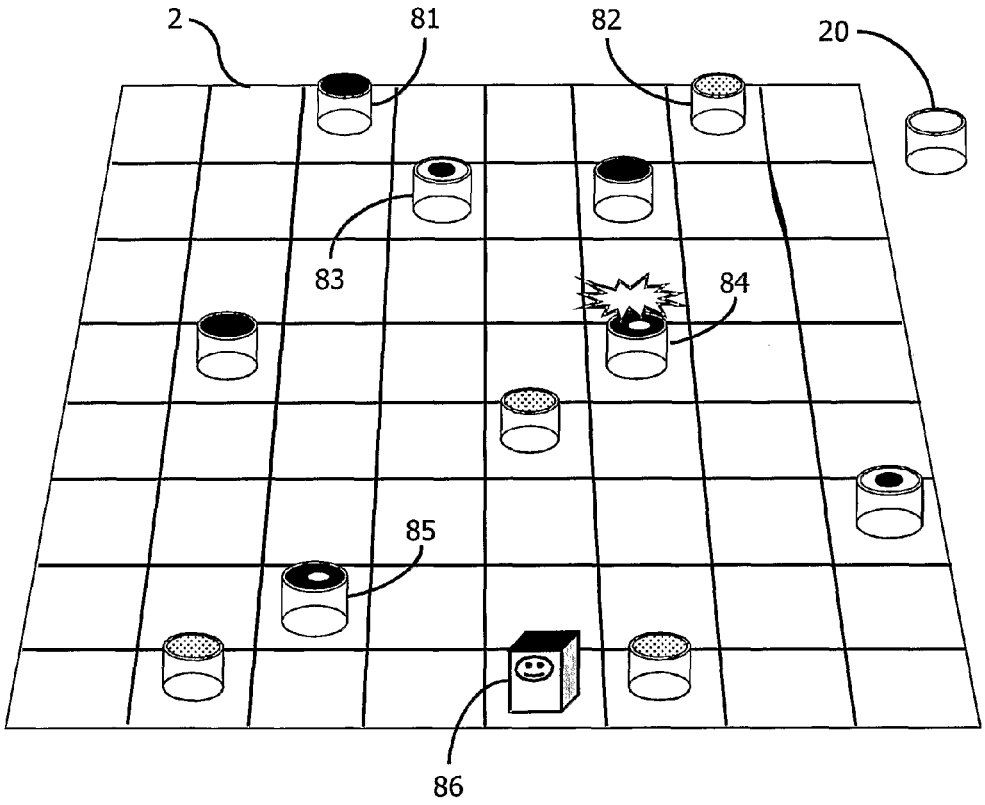
FIG. 8 shows an exemplary setup of a board game, played on a game board according to the invention.

FIG. 8 shows an exemplary setup of a board game, played on a game board 2 according to the invention. In this event the game board layout is a simple matrix of 8×8 fields, but the invention is not limited to such simple game board layouts. The game board 2 shown in FIG. 1, for example, shows a more complicated layout. Next to the board a pawn 20 is positioned, which does not show a pawn output image. The pawns on the game board show several types of output images. The pawns 81, 82 are of the type as shown in FIG. 2 and only show a colored disc as pawn output image. The pawns 83, 84 and 85 are of the type as shown in FIG. 4 and show multi colored images. The pawn output images on a pawn may change several times during a game or may even be continuously moving or blinking images. One pawn 84 in FIG. 8, for example, is blinking. Pawn 86 is of the type as shown in FIG. 6*a* or 6*c*. This pawn 86 shows the face of a game character as a pawn output image.

The pawns according to the invention may have all kinds of different shapes. However preferably, one or a few sets of pawns are provided for enabling a user to play many different games. A user may, for example, own a set of cylindrical pawns of the type as shown in FIG. 4 and a set of bar shaped pawns with two different image surfaces of the type as shown in FIG. 6*c*. Optionally, a user may buy a dedicated set of, for example, transparent Chess pieces which can be colored or highlighted on the board surface 3. Such dedicated Chess pieces may be shaped, for example, like usual Chess pieces, or may be transparent cylinders or bars comprising diffuse elements with the shape of usual Chess pieces.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A game board having pawns for different types of game characters associated with different pawn input images, comprising:

each pawn having a pawn contact surface and an image input part;

the game board having a board surface for supporting the pawns and displaying a selected image selected from a game beard layout image and a pawn input image; and a processor configured to display on the board surface the game board layout image when the pawn contact surface is not in contact with the board surface and display the pawn input linage when the pawn contact surface is in contact with the board surface wherein the pawn input image is received by the image input part of the pawn for display of the pawn input image on a part of the pawn different from the pawn contact surface, wherein the pawn input image includes moving images wherein the processor is further configured to display the pawn input image on the board surface at a position of contact of the board surface with the contact surface of the pawn, and wherein the pawn input image identifies the game character of the pawn.

2. The game board as claimed in claim 1, further comprising a detector configured to detect the contact of the board surface with the contact surface of the pawn and to detect the position of the contact.

3. The game board as claimed in claim 2, wherein the detector is further configured to detect a code on the contact surface.

4. The game board as claimed in claim 3, wherein the processor is further configured to display the pawn input image depending on the code.

5. The game board as claimed in claim 2, wherein the detector is further configured to detect an orientation of the pawn relative to the game board.

6. The game board as claimed in claim 5, wherein the processor is further configured to display the pawn input image depending on the orientation.

7. The game board as claimed in claim 1, wherein the processor is further configured to display a first pawn input image and a second pawn input image on the board surface for reception by the image input part of the pawn.

8. A pawn for a game character associated with a pawn input image, comprising:

a contact surface for supporting the pawn on a board surface of a game board;

an image input part for receiving the pawn input image from the board surface;

at least one image surface for displaying a pawn output image, said at least one image surface being different from the contact surface; and means for conducting the pawn input image to the at least one image surface, wherein the pawn input image comprises a first image part conducted by the means for conducting to a first surface of the at least one image surface of the pawn and a second image part conducted by the means for conducting to a second surface of the at least one image surface of the pawn, wherein the pawn input image includes moving images, wherein the pawn input image is displayed on the board surface at a position of contact of the board surface with the contact surface of the pawn, and wherein the pawn input image identifies the game character of the pawn.

9. The pawn as claimed in claim 8, wherein the contact surface comprises a code for identifying the pawn.

10. The pawn as claimed in claim 8, wherein the means for conducting the pawn input image comprise at least one optical element for obtaining the pawn output image being a representation of the pawn input image.

11. The pawn as claimed in claim 10, wherein the optical element comprises a lens.

12. The pawn as claimed in claim 10, wherein the optical element comprises a lens array.

13. The pawn as claimed in claim 10, wherein the optical element comprises a mirror.

14. The pawn as claimed in claim 10, wherein the optical element comprises a bundle of optical fibers.

15. A system for playing board games comprising a game board having pawns for different types of game characters associated with different pawn input images, comprising:

a pawn having a pawn contact surface and an image input part;

a board having a board surface for supporting the pawn and displaying a selected image including a picture selected from a game board layout image and a pawn input image; and a processor configured to display on the board surface the game board layout image when the pawn contact surface is not in contact with the board surface and display the pawn input image when the pawn contact surface is in contact with the board surface, wherein the pawn input image is received by the image input part of the pawn for display of the pawn input image on at least one image surface of the pawn, said at least one image surface being different from the pawn contact surface, wherein the pawn input image includes moving images, wherein the processor is further configured to display the pawn input image on the board surface at a position of contact of the board surface with the contact surface of the pawn, and wherein the pawn input image identifies the game character of the pawn.

16. The system as claimed in claim 15, further comprising a detector, wherein the pawn contact surface comprises a code for identifying the pawn, and wherein the detector is configured to detect the code.

17. The system as claimed in claim 15, wherein the pawn comprises means for conducting the pawn input image to the at least one image surface, and wherein the pawn input image comprises a first image part conducted by the means for conducting to a first surface of the image surface of the pawn and a second image part conducted by the means for conducting to a second surface of the at least one image surface of the pawn.

18. The game board of claim 1, wherein the pawn input image includes continuously moving images.

19. The pawn of claim 8, wherein the pawn input image includes continuously moving images.

20. The system of claim 15, wherein the pawn input image includes continuously moving images.

* * * * *